US010083566B1

(12) United States Patent
McPake

(10) Patent No.: US 10,083,566 B1
(45) Date of Patent: Sep. 25, 2018

(54) TOWEL DISPENSER

(71) Applicant: Mathew McPake, Oshawa (CA)

(72) Inventor: Mathew McPake, Oshawa (CA)

( * ) Notice: Subject to any disclaimer, the term of this patent is extended or adjusted under 35 U.S.C. 154(b) by 161 days.

(21) Appl. No.: 14/857,861

(22) Filed: Sep. 18, 2015

Related U.S. Application Data

(60) Provisional application No. 62/053,424, filed on Sep. 22, 2014.

(51) Int. Cl.
*G07F 11/62* (2006.01)
*G07F 11/14* (2006.01)

(52) U.S. Cl.
CPC ..... *G07F 11/62* (2013.01); *G07F 11/14* (2013.01)

(58) Field of Classification Search
CPC ..... A47K 10/025
See application file for complete search history.

(56) References Cited

U.S. PATENT DOCUMENTS 1,225,390 A 5/1917 Anderson
1,367,033 A 2/1921 Fritsche
1,386,814 A 8/1921 Van der Wyk
1,437,970 A 12/1922 Fritsche et al.
2,190,879 A 2/1940 Mayfield
2,445,495 A 7/1948 Rousso
2,849,153 A * 8/1958 Tuttle ..... A47K 10/422 221/154
2,929,480 A * 3/1960 Black ..... A47K 10/26 194/211
5,373,950 A 12/1994 Marc
6,561,601 B1 * 5/2003 Maffeo ..... A47B 47/0075 312/257.1
2003/0222545 A1 * 12/2003 Stravitz ..... A47F 3/004 312/111
2004/0163684 A1 * 8/2004 Hapke ..... A47L 15/4259 134/57 DL
2006/0289558 A1 * 12/2006 Parker ..... A47K 10/3818 221/97
2008/0277359 A1 11/2008 St. Martin
2012/0187059 A1 7/2012 Sisto

* cited by examiner

*Primary Examiner* — Gene O Crawford
*Assistant Examiner* — Ayodeji T Ojofeitimi
(74) *Attorney, Agent, or Firm* — Cramer Patent & Design, PLLLC; Aaron R. Cramer

(57) ABSTRACT

A dispenser particularly suited for dispensing towels has a general cabinet shape with an elevating platform on which the folded towels are loaded. The user withdraws a towel from an upper access opening which causes the stack to raise and present the next towel to the access. The platform is spring loaded to rise as towels are removed.

4 Claims, 9 Drawing Sheets

TOWEL DISPENSER

RELATED APPLICATIONS

The present invention was first described in and claims the benefit of U.S. Provisional Application No. 62/053,424 filed Sep. 22, 2014, the entire disclosures of which are incorporated herein by reference.

FIELD OF THE INVENTION

The present invention relates generally to a multi-compartment dispenser with an elevating platform on which items are loaded.

BACKGROUND OF THE INVENTION

Convenience is continually growing as an important factor in the products that we, as consumers, choose to buy. As our lives become increasingly busy and hectic, more and more we are finding ourselves faced with performing our daily activities in an ever decreasing amount of time. It is due to this fact that the marketplace has seen an insurgence of products designed to provide convenience, reduce congestion, and reduce the amount of time that even the most trivial of chores consume.

One (1) trivial chore that most must do every day is keep track of towels used in a bathroom. Clean towels should ideally be stored and organized in order to easily locate them subsequent to showering or to bathing. Clean towels and soiled towels should also ideally be kept separate. Once a towel becomes soiled it should be cleaned and folded to be put back into circulation. This cumbersome routine also appears in hotels, gyms, swimming pools, and just about any location where towels are frequently used.

Accordingly, there exists a need for a means by which towels can be stored, organized, dispensed, and collected in a time and space saving manner. The use of the dispenser allows one to keep clean towels clean and off the floor thereby away from dirt and germs, while holding used towels and other bathroom supplies in a manner which is quick, easy, and efficient.

SUMMARY OF THE INVENTION

The inventor has recognized the aforementioned inherent problems and lack in the art and observed that there is a need for such a towel dispenser.

It is therefore an object of the invention to provide at least one (1) of a multitude of components, including a towel bin configured to hold a plurality of towels within a towel bin interior, a hamper configured to receive a plurality of items within a hamper, a wash cloth bin configured to hold a plurality of wash cloths therein, and a cabinet configured to receive a plurality of other items therein. The hamper, wash cloth bin, and cabinet are each capable of being removably attached to the towel bin with at least one (1) connection means.

An aspect of the invention is to provide such a towel bin having a rear towel bin wall, a pair of towel bin sidewalls, a towel bin top, and a towel bin bottom. The towel bin also includes a pair of towel bin stiles attached to front edges of the pair of towel bin sidewalls, a towel bin tray attached to the towel bin bottom via a towel bin spring, which biases the towel bin tray towards the towel bin top, a towel bin door hingedly attached to one (1) towel bin stile and capable of being secured to an opposite towel bin stile, a towel bin door aperture in communication with the towel bin interior, and a towel bar disposed along an outer face of the towel bin door. The towel bin tray is configured to retain a vertical stack of the plurality of towels thereon. The dispenser further includes a towel bin first latch located on the towel bin bottom configured to correspondingly engage a towel bin second latch located on the towel bin tray to retain the towel bin tray at a desired elevation above the towel bin bottom.

An aspect of the invention is to provide such a hamper further having a planar bottom and four (4) planar vertical hamper sidewalls.

Yet another aspect of the invention is to provide such a wash cloth bin further including a rear wash cloth bin wall, a pair of wash cloth bin sidewalls, a wash cloth bin bottom, a wash cloth bin top, a pair of wash cloth bin stiles attached to front edges of the pair of wash cloth bin sidewalls, a wash cloth bin tray attached to the wash cloth bin bottom via a wash cloth bin spring which biases the wash cloth bin tray towards the wash cloth bin top, and a wash cloth bin door hingedly attached to one (1) wash cloth in stile and capable of being secured to an opposite washcloth bin stile further having a wash cloth bin door aperture in communication with the wash cloth bin interior. The wash cloth bin tray is configured to retain a vertical stack of the plurality of wash cloths thereon.

Yet another aspect of the invention is to provide such a cabinet further including a cabinet rear wall, a pair of cabinet sidewalls, a cabinet bottom, and a cabinet top. There is a first cabinet stile attached to a front edge of one (1) cabinet sidewall, a second cabinet stile attached to a front edge of an opposite cabinet sidewall, a cabinet first door hingedly attached to the first cabinet stile, a cabinet bin second door hingedly attached to the second cabinet stile, a cabinet door pull attached to a mid-portion of the cabinet first door, a cabinet door latch assembly securing both the cabinet first door and the cabinet second door in a closed position to the cabinet top, and a planar cabinet shelf attached to the interior of the pair of cabinet sidewalls.

An aspect of the invention is to provide such a connection means including a first connector affixed to an exterior of a sidewall of the towel bin capable of removably interconnecting to a second connector affixed to an exterior of a sidewall of the hamper. Another first connector is capable of removably interconnecting to a third connector affixed to an exterior of a sidewall of the wash cloth bin. Yet another first connector is capable of removably interconnecting to a fourth connector affixed to an exterior of a sidewall of the cabinet. It is appreciated that any other combination of attachments can be made with the basic components of the invention (i.e., the towel bin, the hamper, the wash cloth bin, and the cabinet).

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
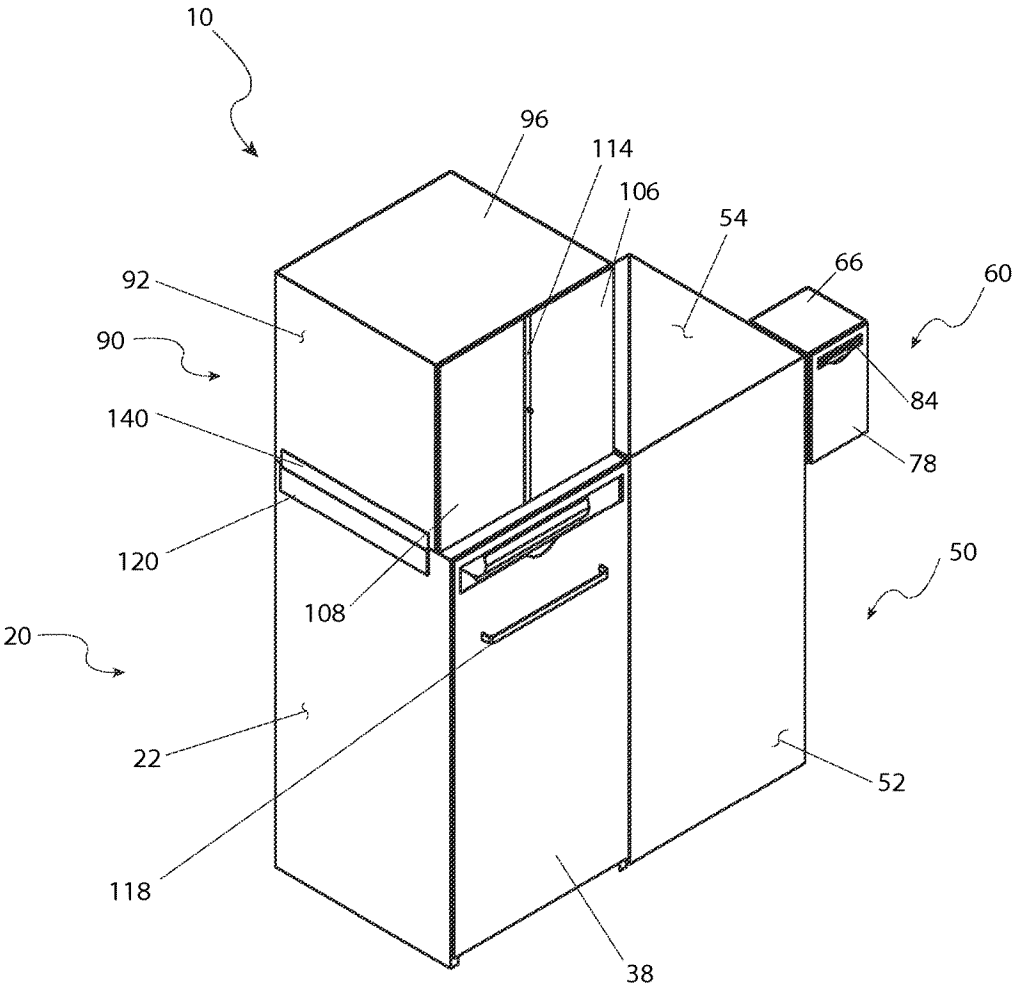
FIG. 1 is an isometric view of a towel dispenser 10 in accordance with the preferred embodiment of the present invention.

10 towel dispenser
20 towel bin
22 towel bin sidewall
24 towel bin bottom
26 towel bin top
28 towel bin interior
32 towel bin tray
34 towel bin tray upper face
36 towel bin spring
38 towel bin door
42 towel bin door hinge
44 towel bin door aperture
46 towel bin stile
48 towel bin magnetic latch
50 hamper
52 hamper sidewall
54 hamper interior
60 wash cloth bin
62 wash cloth bin sidewall
64 wash cloth bin bottom
66 wash cloth bin top
68 wash cloth bin interior
72 wash cloth bin tray
74 wash cloth bin tray upper face
76 wash cloth bin spring
78 wash cloth bin door
82 wash cloth bin door hinge
84 wash cloth bin door aperture
86 wash cloth bin stile
88 wash cloth bin magnetic latch
90 cabinet
92 cabinet sidewall
94 cabinet bottom
96 cabinet top
98 cabinet interior
102 cabinet shelf
104 cabinet stile
106 cabinet first door
108 cabinet second door
112 cabinet door hinge
114 cabinet door pull
116 cabinet door magnetic latch
118 towel bar
120 first connector
122 cup
124 cup attachment leg
126 cup channel
128 cup lip
130 second connector
132 bell
134 bell attachment leg
136 bell channel
138 bell lip
140 cabinet connector
142 strip attachment leg
144 offset
146 connector lip
152 bath towel
154 wash cloth
160 towel bin tray latch
162 shelf hook
164 slide bar
166 slide bar hook
168 slide bar holder
174 slide bar return spring
176 spring stop
178 striker plate

DETAILED DESCRIPTION OF THE PREFERRED EMBODIMENT

The best mode for carrying out the invention is presented in terms of its preferred embodiment, herein depicted within FIGS. 1 through 9. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a towel dispenser (herein referred to as the "apparatus") 10, which provides a means to store a plurality of various bath linens within a combination of attached enclosures in such a manner as to have an item individually accessible to a user through a door aperture 44, 84 and upon removal of that item from the apparatus 10 another of the same item immediately becomes accessible. Separate conjoined enclosures 50, 60 are available for the storage of bath towels 152 and for wash cloths 154. The apparatus 10 also incorporates an attached hamper 50 as a repository for the collection of soiled bath linens as well as a cabinet 90 for the storage of other sundry bath items.

Referring now to FIG. 1, an isometric view of the apparatus 10 according to the preferred embodiment of the present invention, is disclosed. The apparatus 10 includes a towel bin 20, a wash cloth bin 60, a hamper 50 and a cabinet 90. The towel bin 20 is preferably constructed of steel sheet material having a protective coating, or plating, to inhibit corrosion as well as increasing aesthetic appeal, and formed by various metal working procedures. It is understood that other materials, and other methods of construction, can be utilized without limiting the scope of the apparatus 10. The towel bin 20 is configured to be formed with at least three (3) towel bin sidewalls 22 joined along the vertical abutting edges and provided with an attached towel bin bottom 24 and a towel bin top 26 so as to form a hollow towel bin interior 28. A fourth vertical face of the towel bin 20 is configured to be two (2) towel bin stiles 46 attached to each of the opposing towel bin sidewalls 22 having a towel bin door 38 attached to one (1) of the towel bin stiles 46 by means of at least one (1) towel bin door hinge 42 so as to cover an opening between the towel bin stiles 46. The towel bin door 38 is provided with a towel bin magnetic latch 48 to retain the towel bin door 38 in a closed position. The opening between the towel bin stiles 46 is utilized to insert a plurality of clean bath towels 154 as well as providing access for the removal of an individual bath towel 154. The towel bin door 38 is provided with a towel bin door aperture 44 through which a bath towel 152 may be removed from the towel bin interior 28 for use. Disposed along an outer face of the towel bin door 38 is a towel bar 142. The towel bar 142 is a horizontal, arcuate bar, having any of a variety of cross-sectional profiles, attached to the towel bin door for the purpose of provisionally suspending an item of bath linen 150 to suit the purposes of a user.

Figure 4:
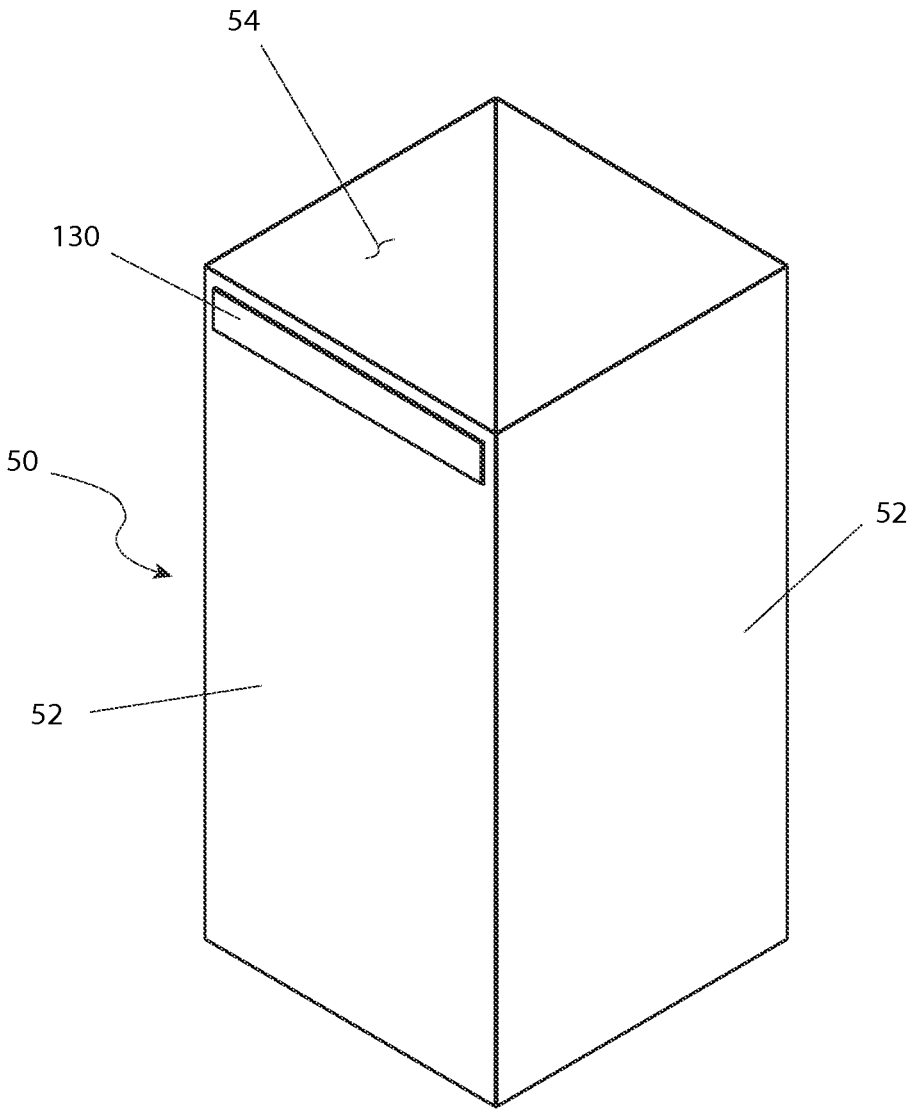
FIG. 4 is an isolated view of a hamper 50 of the towel dispenser 10 in accordance with the preferred embodiment of the present invention.

A hamper 50 is attached to the towel bin 20 by means of a first connector 120 permanently attached to the exterior surface of a towel bin sidewall 22 removably interconnected to a second connector 130 which is permanently attached to an exterior surface of a hamper sidewall 52 as illustrated more clearly in FIG. 4. The hamper 50 is preferably constructed similarly to the towel bin 20 utilizing a steel sheet material having a protective coating, or plating, to inhibit corrosion as well as increasing aesthetic appeal, and formed by various metal working procedures. The hamper 50 is configured to be fabricated with a planar bottom (not shown) and four (4) planar vertical hamper sidewalls 52 formed perpendicularly along the horizontal edges of the bottom in one (1) piece to define a hollow hamper interior 54.

The wash cloth bin 60 is constructed similarly to the towel bin 20. The wash cloth bin 60 is configured to be formed with at least three (3) wash cloth bin sidewalls 62 joined along the vertical abutting edges and provided with an attached wash cloth bin bottom 64 and a wash cloth bin top 66 so as to form a hollow wash cloth bin interior 68. A fourth vertical face of the wash cloth bin 60 is configured to be two (2) wash cloth bin stiles 86 attached to each of the opposing wash cloth bin sidewalls 62 having a wash cloth bin door 78 attached to one (1) of the wash cloth bin stiles 86 by means of at least one (1) wash cloth bin door hinge 82 so as to cover an opening between the wash cloth bin stiles 86. The wash cloth bin door 78 is provided with a wash cloth bin magnetic latch 88 to retain the wash cloth bin door 78 in a closed position. The opening between the wash cloth bin stiles 86 is utilized to insert a plurality of clean wash cloths 154 as well as providing access for the removal of an individual wash cloth 156. The wash cloth bin door 78 is provided with a wash cloth bin door aperture 84 through which a wash cloth 154 may be removed from the wash cloth bin interior 68 for use.

Figure 6:
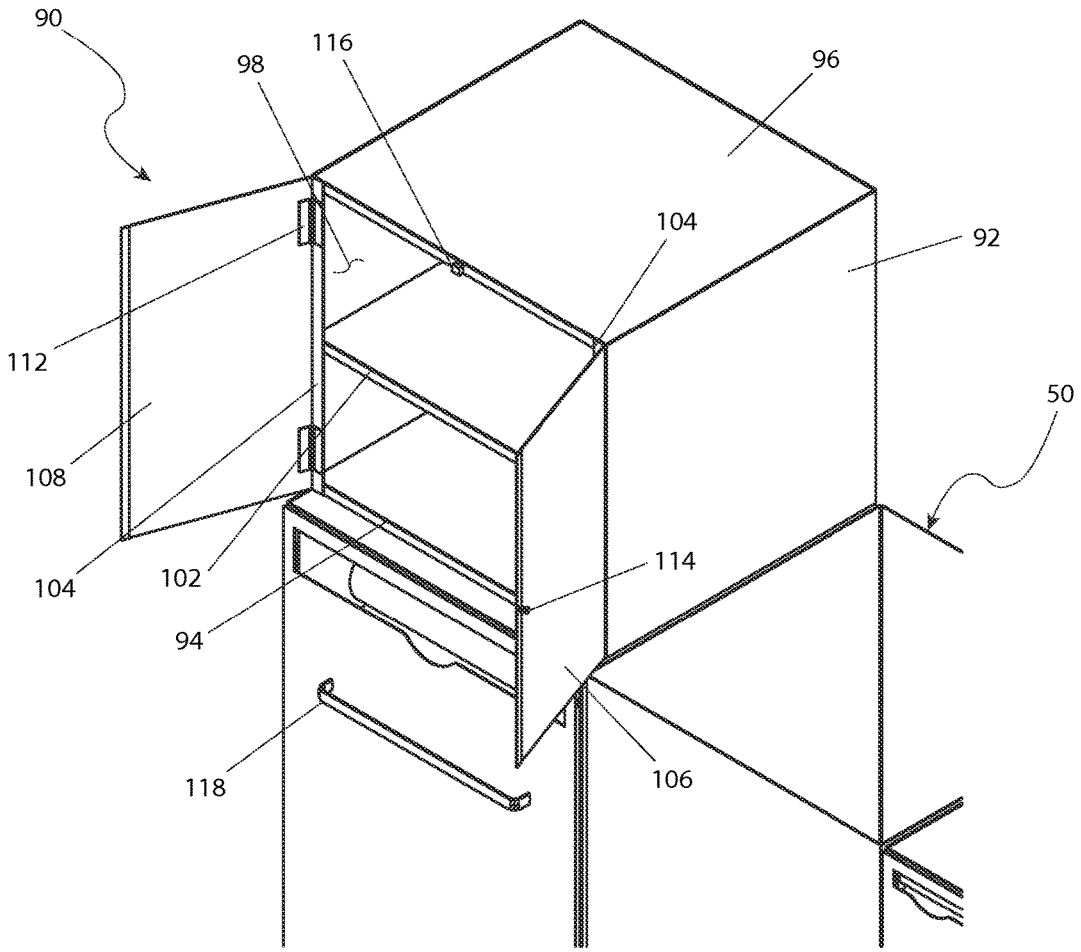
FIG. 6 is an isolated view of a top mounted cabinet 90 of the towel dispenser 10 with a cabinet first door 106 and a cabinet second door 108 open to reveal a cabinet interior 98 in accordance with the preferred embodiment of the present invention.

The cabinet 90 is an enclosure 16 having a cabinet first door 106 which closes upon an opposing cabinet second door 108 for the storage of selected bath items other than bath linens. The cabinet 90 is configured to be formed with at least three (3) cabinet sidewalls 92 joined along the vertical abutting edges and provided with an attached cabinet bottom 94 and a cabinet top 96 so as to form a hollow cabinet interior 98. A fourth vertical face of the cabinet 90 is configured to be two (2) cabinet stiles 104 attached to, or formed integrally with, each of the opposing cabinet sidewalls 62 having a cabinet first door 106 attached to one (1) of the cabinet stiles 104 by means of at least one (1) cabinet door hinge 112. The cabinet second door 108 is attached to the opposite cabinet stile 104 by means of at least one (1) cabinet door hinge 112. The cabinet first door 106 and the cabinet second door 108 are configured to extend from the cabinet stiles 104 and overlap at a central portion of the cabinet 90 so as to enclose any stored items within the cabinet interior 98. A cabinet door pull 114, preferably configured to be a cylindrical knob having any relief, embossment, or design, is attached to a mid-portion of the cabinet first door 106 for the purpose of allowing a user to pivotally open the cabinet first door 106. A cabinet door magnetic latch 116 is provided along some vertical edge of the cabinet top 96 to secure the cabinet first door 106 and the cabinet second door 108 in a closed position. A planar cabinet shelf 102 is attached to the interior of the cabinet sidewalls 92 approximately midway between the cabinet bottom 94 and the cabinet top as depicted in FIG. 6.

Figure 2:
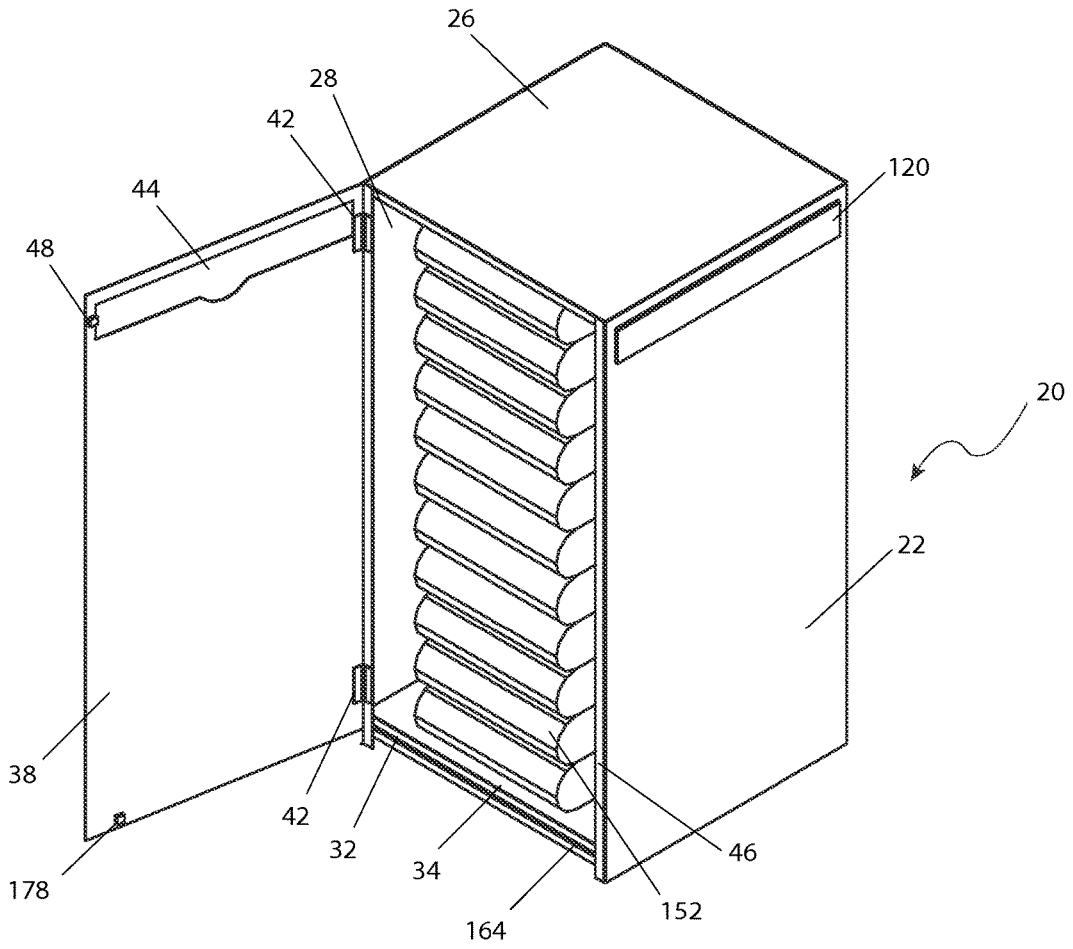
FIG. 2 is an isolated view of a towel bin 20 of the towel dispenser 10 with a towel bin door 38 open to reveal a towel bin interior 28 in accordance with the preferred embodiment of the present invention.
Figure 3:
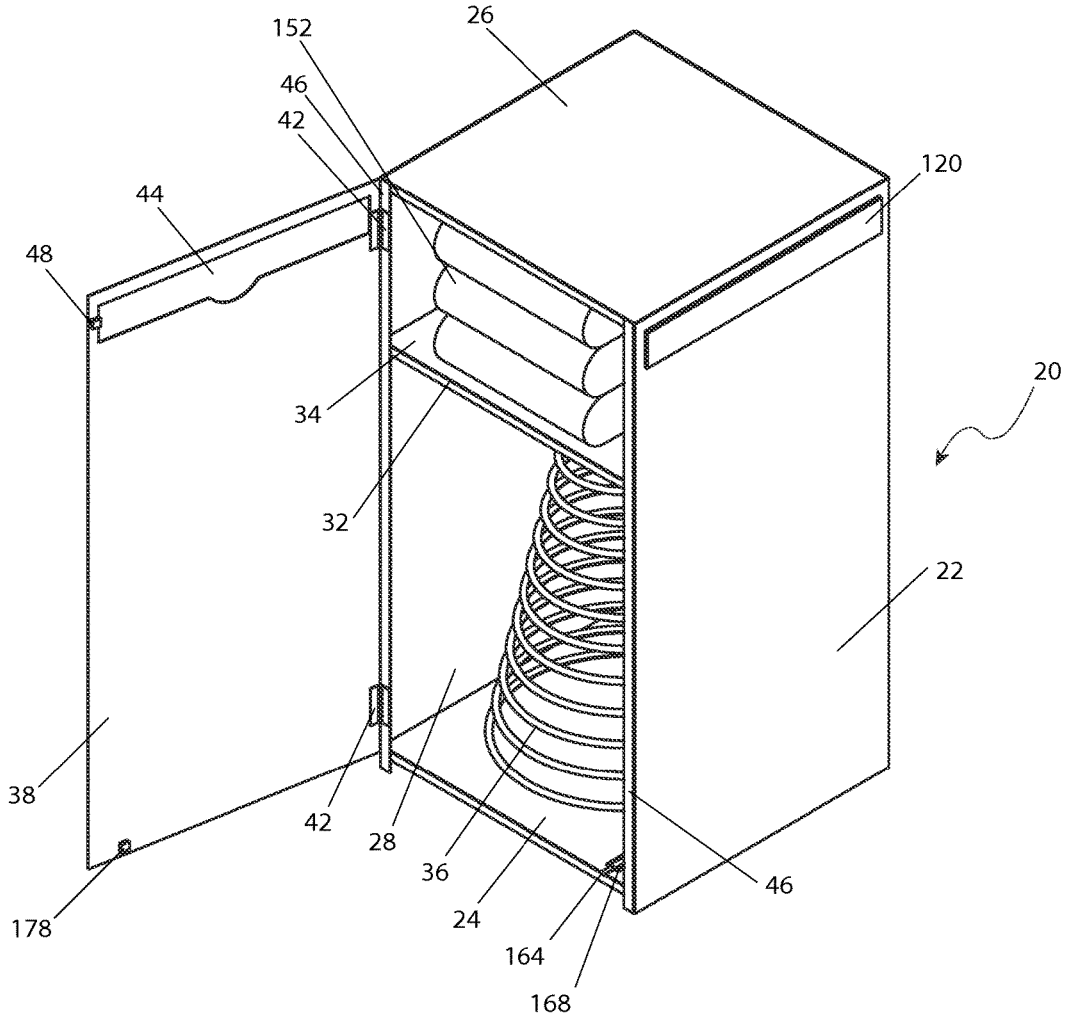
FIG. 3 is an isolated view of the towel bin 20 of the towel dispenser 10 depicted with a towel bin tray 32 in an up position in accordance with the preferred embodiment of the present invention.

Referring now to FIGS. 2 and 3, isolated views of the towel bin 20 of apparatus 10, with a towel bin door 38 in an open configuration, according to the preferred embodiment of the present invention, are disclosed. The towel bin 20 is provided with a conical, coiled towel bin spring 36 upon which a towel bin tray 32 is disposed as seen in FIG. 3. The towel bin spring 36 is placed upon the towel bin bottom 24 with the larger diameter coil in contact with the towel bin bottom 24. In use, a plurality of bath towels 152 are placed upon the towel bin tray upper face 34 in such a manner as to compress the towel bin spring 36. The towel bin spring 36 is specifically fabricated to deflect with the weight of the bath towels 154 placed upon the towel bin tray 32 in such a manner as to hold the uppermost bath towel 154 within proximity to the towel bin top 26, and accessible through the towel bin door aperture 44 regardless of the quantity of bath towels 154 in the stack. In this manner, as one (1) bath towel 154 is removed through the towel bin door aperture 44 of the closed towel bin door 38 the next successive bath towel 154 is raised to the vertical level of the towel bin door aperture 44 for immediate accessibility.

Figure 5:
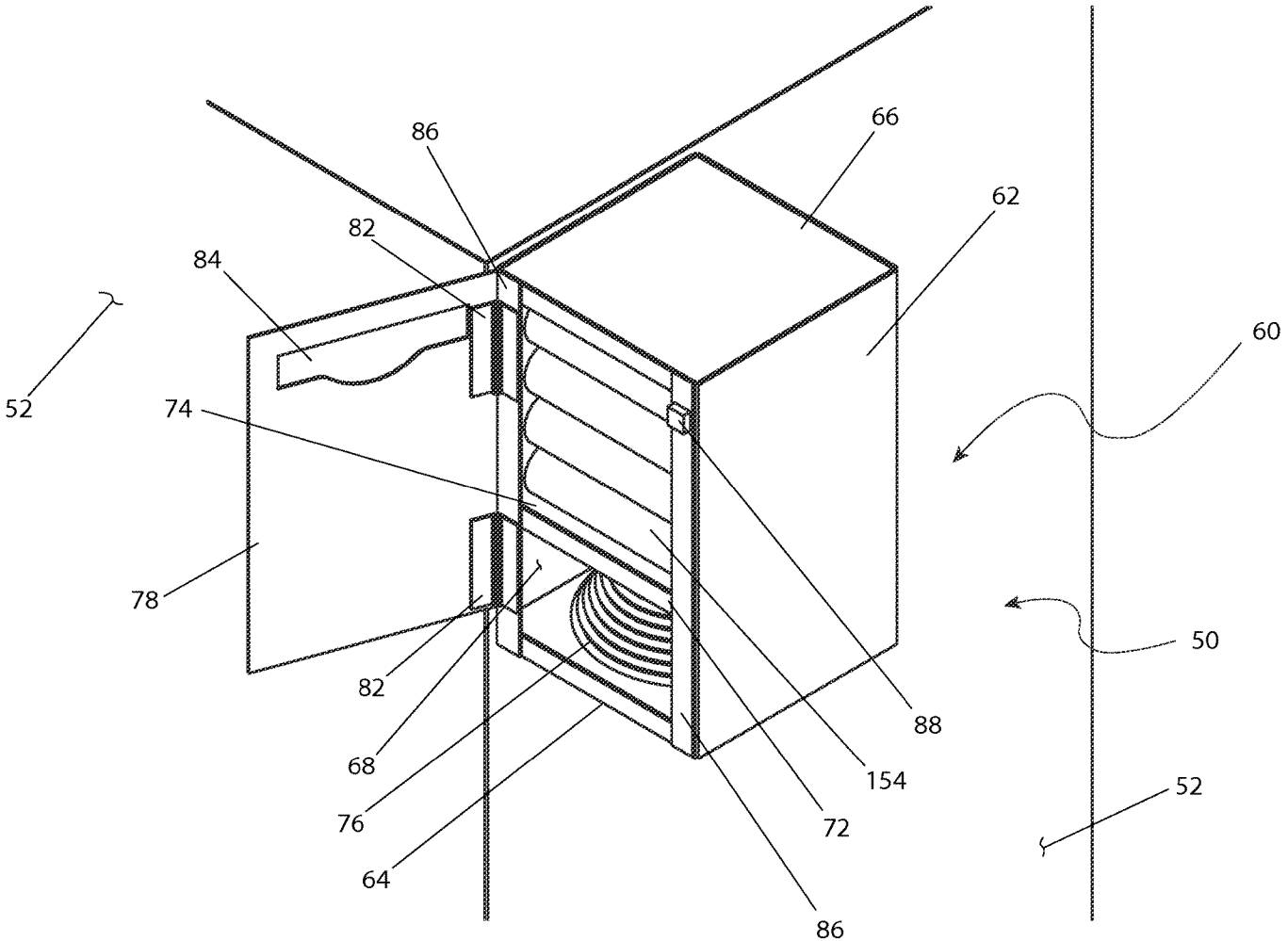
FIG. 5 is an isolated view of a wash cloth bin 60 of the towel dispenser 10 with a wash cloth bin door 78 open to reveal a wash cloth bin interior 68 in accordance with the preferred embodiment of the present invention.

Referring now to FIG. 5, an isolated view of the wash cloth bin 60 of the apparatus 10, with the wash cloth bin door 78 in an open configuration, according to the preferred embodiment of the present invention, is disclosed. As previously mentioned the wash cloth bin 60 is constructed similarly to the towel bin 20. The wash cloth bin 60 is provided with a conical, coiled wash cloth bin spring 76 upon which a wash cloth bin tray 72 is disposed. The wash cloth bin spring 76 is placed upon the wash cloth bin bottom 64 with the larger diameter coil in contact with the wash cloth bin bottom 64. In use, a plurality of properly folded wash cloths 156 are placed upon the wash cloth bin tray upper face 74 in such a manner as to compress the wash cloth bin spring 76. The wash cloth bin spring 76 is specifically fabricated to deflect with the weight of the wash cloths 156 placed upon the wash cloth bin tray 72 in such a manner as to hold the uppermost wash cloth 156 within proximity to the wash cloth bin top 66, and accessible through the wash cloth bin door aperture 84 regardless of the quantity of wash cloths 154 in the stack, similar to the towel bin spring 36. It is understood from this discussion that a similarly constructed enclosure 16 may be configured in any alternate embodiment to contain a stacked quantity of any other item of bath linen, such as hand towels or the like without limiting the scope of this apparatus 10.

Figure 7:
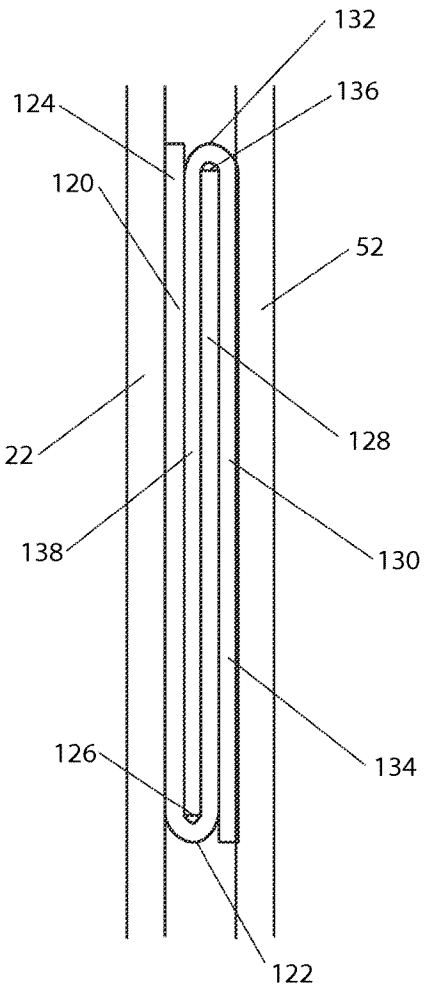
FIG. 7 is an isolated view of a first connector 120 and a second connector 130 of the towel dispenser 10 in accordance with the preferred embodiment of the present invention.

Referring now to FIG. 7, an isolated view of a first connector 120 and a second connector 130 of the apparatus 10, according to the preferred embodiment of the present invention, is disclosed. The first connector 120 is preferably a length of sheet steel formed into a "U"-shape and having a protective coating, or plating, to inhibit corrosion as well as increasing aesthetic appeal. The first connector 120 is configured as a cup 122 with a first vertical leg permanently affixed to an exterior surface of a sidewall 22, or 52 of the towel bin 20 or the hamper 50 as a cup attachment leg 124. A second vertical leg forms a cup lip 128 with an intervening cup channel 126. A second connector 130 is formed in inverted "U"-shape as a bell 132. A first vertical leg is permanently affixed to an exterior surface of a sidewall 52, or 62 of the hamper 50 or the wash cloth bin 60 as a bell attachment leg 134. A second vertical leg forms a bell lip 138 with an intervening bell channel 136. In use, the towel bin 20 or hamper 50 to which the bell 132 is attached is raised for interconnection with the opposing side of the hamper 50, or wash cloth bin 60, to which the cup 122 is attached. The bell lip 138 is inserted into the cup channel 126 simultaneously with the insertion of the cup lip 128 into the bell channel 136. The raised hamper 50 or wash cloth bin 60 is lowered such that the cup lip 128 and the bell lip 138 become fully engaged within the respective channels 126, 136.

Figure 8:
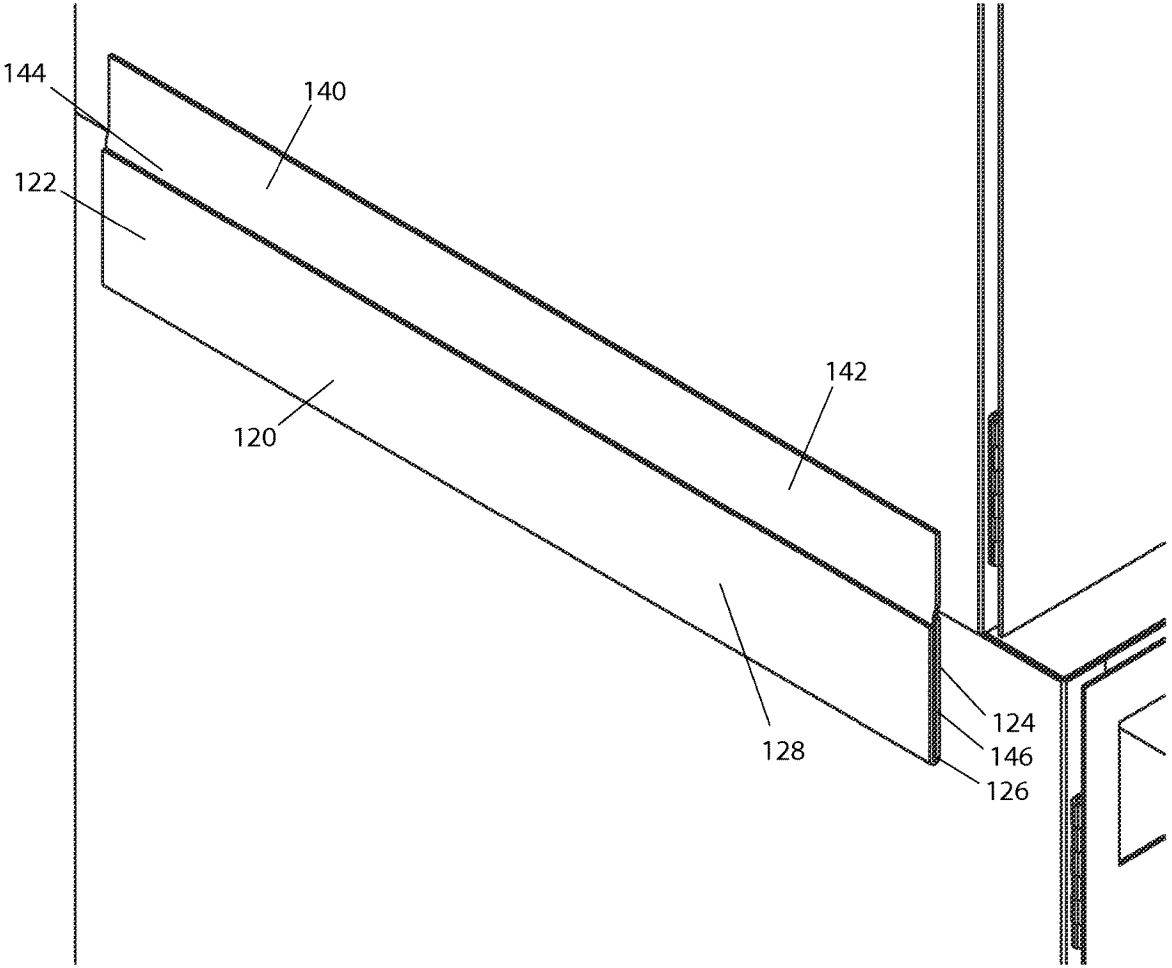
FIG. 8 is an isolated view of a first connector 120 and a cabinet connector 140 of the towel dispenser 10 in accordance with the preferred embodiment of the present invention; and, FIG. 9 is an isolated view of a towel bin tray latch 160 of the towel dispenser 10 in accordance with the preferred embodiment of the present invention.

Referring now to FIG. 8, an isolated view of a first connector 120 and a cabinet connector 140 of the apparatus 10, according to the preferred embodiment of the present invention, is disclosed. The cabinet connector 140 is preferably a piece of sheet steel formed with an offset 144 between a vertical strip attachment leg 142 and a vertical connector lip 146. The cabinet connector 140 is provided with a protective coating, or plating, to inhibit corrosion as well as increase aesthetic appeal. The cabinet connector 140 is permanently affixed to the exterior of a cabinet sidewall 92 via the strip attachment leg 124 with the connector lip 146 projecting downwardly. In use, the cabinet 90 is configured to be placed atop the towel bin 20 with the cabinet bottom 94 supported on the towel bin top 26. At least one (1) cabinet connector 140 is utilized with the connector lip 146 engaged within the cup channel 126 of a first connector as shown.

Figure 9:
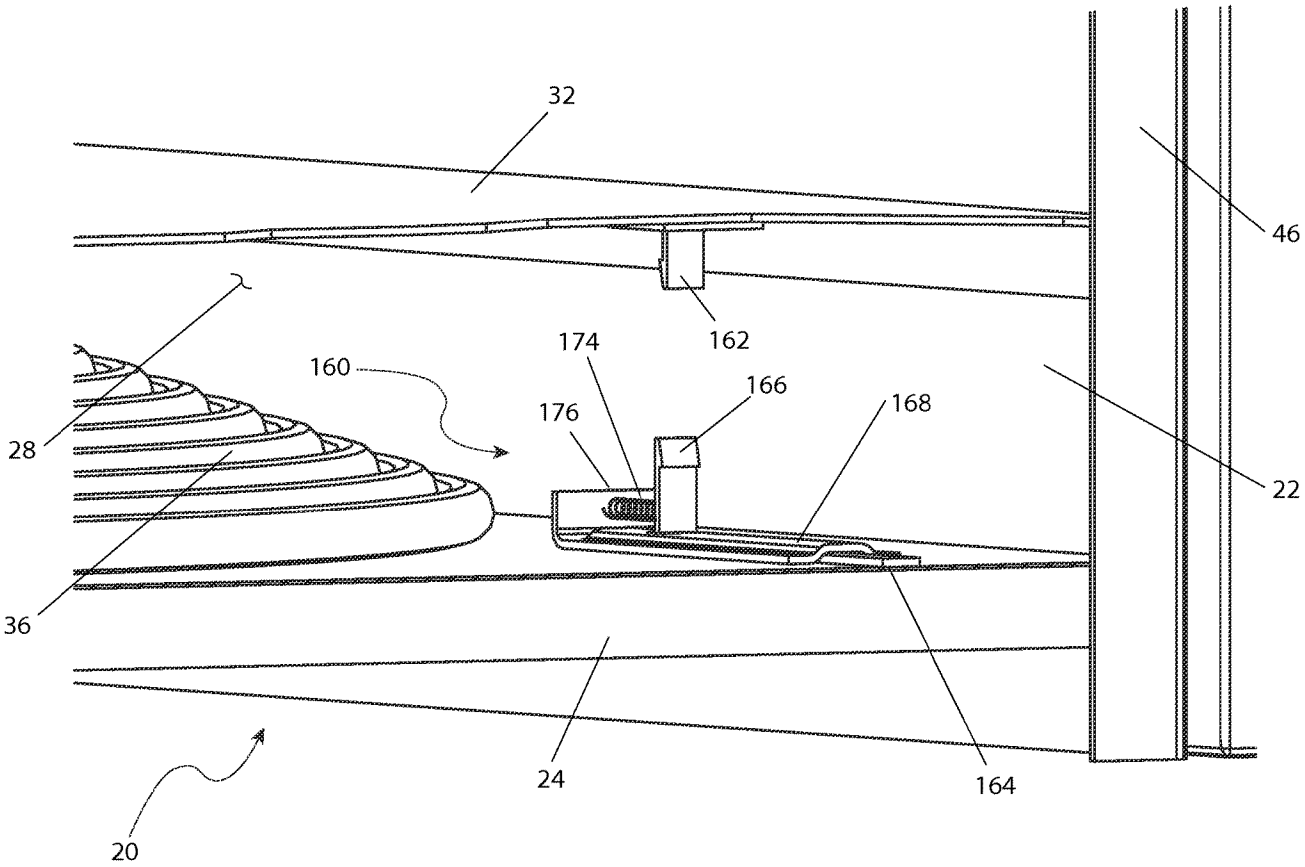

Referring now to FIG. 9, an isolated view of a towel bin tray latch 160 of the apparatus 10, according to the preferred embodiment of the present invention, is disclosed. Disposed on an upper surface of the towel bin bottom 24 and the lower surface of the towel bin tray 32 is a towel bin tray latch 160. This towel bin tray latch 160 is configured to be a combination of a slide bar 164, having a slide bar hook 166, mounted to the towel bin bottom 24 and a shelf hook 162 attached to the towel bin tray 32. The slide bar 164 is preferably an "L"-shaped bar having a straight slide portion and a perpendicular slide bar hook 166. The slide bar hook 166 is configured to have an angularly protruding face at an upper edge of a first side which abruptly changes to a recessed vertical face thereby providing a downwardly oriented ledge. The slide bar 164 is retained upon the towel bin bottom 24 by a slide bar holder 168 which is attached to the towel bin bottom 24. The slide bar holder 168 is configured to be a formed plate having a central channel in which the slide bar 164 moves and lateral flanges which support the slide bar holder 168 and by which an attachment is made with the towel bin bottom 24. The slide bar 164 projects from a first end of the slide bar holder 168 and extends beyond the towel bin bottom 24 toward the towel bin door 38. The slide bar holder 168 is provided with an aperture through which the vertically oriented slide bar hook 166 projects. The slide bar holder 168 is also provided with a spring stop 176 which is a vertical abutment located at a second end of the slide bar holder 168. A slide bar return spring 174 is positioned in a space between the slide bar hook 166 and the spring stop 176. The slide bar return spring 174 is configured to be a compression spring intended to exert a biasing force upon the slide bar hook 166 so as to preferentially position the slide bar hook 166 into an engagement position with a shelf hook 162. The shelf hook 162 is configured to be a vertical bar projecting downwardly from a horizontal, planar attachment plate. The shelf hook 162 is attached to the lower surface of the towel bin tray 32 with this attachment plate. The shelf hook 162 has a planar vertical face on a first side and an angularly protruding face at a lower edge of a second side which changes abruptly to a vertical recessed face thereby providing an upwardly oriented ledge. The slide bar hook 166 and the shelf hook 162 are relatively positioned so as to, in a given condition, become entangled with each other and retain the towel bin tray 32 at a specific elevation above the towel bin bottom 24. A striker plate 178 is attached to the towel bin door 38, as seen in FIGS. 2 and 3, in such a position so as to interfere with the slide bar 164 when the towel bin door 38 is in a closed position. The striker plate 178 is configured to alter the position of the slide bar 164 in such a way as to compress the slide bar return spring 174 and move the slide bar hook 166 to a location which will no longer support an engagement with the shelf hook 163 thereby releasing the towel bin tray 32. This towel bin tray latch 160, or a similarly configured device, could be adapted for use within the wash cloth bin 60 to accomplish a similar function therein.

The preferred embodiment of the present invention can be utilized by an enabled individual in a simple and straightforward manner with little or no training. After initial purchase or acquisition of the apparatus 10, it would be assembled as indicated in FIG. 1.

The method of installing and utilizing the apparatus 10 may be achieved by performing the following steps: acquiring a model of the apparatus 10 having a desired color to suit the taste of a user; placing the towel bin 20 in the desired location; raising the hamper 50 in juxtaposition to the towel bin 20 to engage the second connector 130 attached to the hamper sidewall 52 into the first connector 120 attached to the towel bin sidewall 22; lowering the hamper 50 to attach the second connector 130 to the first connector 120; raising the wash cloth bin 60 in proximity to the hamper 50 to engage the second connector 130 attached to the wash cloth bin sidewall 62 into the first connector 120 attached to the hamper sidewall 52; lowering the wash cloth bin 60 to attach the second connector 130 to the first connector 120; placing the cabinet 90 atop of the towel bin 20 in such a manner as to attach the cabinet connector(s) 140 onto the first connector(s) 120 attached to the exterior of the towel bin sidewalls 22; opening the towel bin door 38; depressing the towel bin tray 32 manually against the force of the towel bin spring 36 toward the towel bin bottom 24 so as to enable the shelf hook 162 of the towel bin tray latch 160 to engage with the slide bar hook 166 thus retaining the towel bin tray 32 in that depressed position; placing the selected quantity of folded bath towels 152 upon the towel bin tray 32; closing the towel bin door 38 thus enabling the striker plate 178, attached to the towel bin door 38, to displace the slide bar 164 of the towel bin tray latch 160 in turn releasing the shelf hook 162 and permitting the stack of bath towels 152 to be elevated to the towel bin door aperture 44; repeating a similar procedure with the wash cloth bin 60 to place a supply of clean wash cloths 156 therein for use; opening the cabinet first door 106 and the cabinet second door 108 to place selected items within the cabinet interior 98; closing the cabinet doors 106, 108; selecting a wash cloth 156 from the wash cloth bin door aperture 84; utilizing the wash cloth 156 in the usual manner to perform the required bath time cleaning; selecting a bath towel 152 from the towel bin door aperture 44 to dry oneself and depositing the used bath towel 152 and wash cloth 154 into the hamper 50. Subsequent utilization of the apparatus 10 would not require those steps involved with the original installation. However, the supply of bath towels 152 and wash cloths 154 will require occasional replenishment.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A dispenser, comprising:

a towel bin holding a plurality of towels within a towel bin interior comprising:

a rear towel bin wall, a pair of towel bin sidewalls, a towel bin top, and a towel bin bottom;

a pair of towel bin stiles attached to front edges of said pair of towel bin sidewalls;

a towel bin tray attached to said towel bin bottom via a towel bin spring, said towel bin spring biasing said towel bin tray towards said towel bin top;

a towel bin door hingedly attached to one towel bin stile and capable of being secured to an opposite towel bin stile, further having a towel bin door aperture in communication with said towel bin interior;

a towel bar disposed along an outer face of said towel bin door;

a plurality of connection means upon an exterior of said towel bin comprising:

a first connector affixed to an exterior of a sidewall of said towel bin;

a second connector affixed to an exterior of a sidewall of said hamper;

wherein an individual first connector is removably interconnected to an individual second connector;

wherein said towel bin tray retains a vertical stack of said plurality of towels, thereon;

a towel bin first latch located on said towel bin bottom correspondingly engaging a towel bin second latch located on said towel bin tray to retain said towel bin tray at a desired elevation above said towel bin bottom;

a hamper attached to said towel bin with at least one of said connection means, receiving a plurality of items within a hamper interior comprising:

a planar bottom; and four planar vertical hamper sidewalls.

2. A dispenser, comprising:

a towel bin holding a plurality of towels within a towel bin interior, further having a plurality of connection means upon an exterior thereof comprising:

a rear towel bin wall, a pair of towel bin sidewalls, a towel bin top, and a towel bin bottom;

a pair of towel bin stiles attached to front edges of said pair of towel bin sidewalls;

a towel bin tray attached to said towel bin bottom via a towel bin spring, said towel bin spring biasing said towel bin tray towards said towel bin top;

a towel bin door hingedly attached to one towel bin stile and capable of being secured to an opposite towel bin stile, further having a towel bin door aperture in communication with said towel bin interior;

a towel bar disposed along an outer face of said towel bin door;

a plurality of connection means upon an exterior of said towel bin comprising:

a first connector affixed to an exterior of a sidewall of said towel bin;

a second connector affixed to an exterior of a sidewall of said hamper;

a third connector affixed to an exterior of a sidewall of said wash cloth bin;

wherein an individual first connector is removably interconnected to an individual second connector;

wherein another individual first connector is removably interconnected to an individual third connector;

wherein said towel bin tray retains a vertical stack of said plurality of towels, thereon;

a towel bin first latch located on said towel bin bottom correspondingly engages a towel bin second latch located on said towel bin tray to retain said towel bin tray at a desired elevation above said towel bin bottom;

a hamper attached to said towel bin with at least one of said connection means, receiving a plurality of items within a hamper interior comprising:

a planar bottom;

four planar vertical hamper sidewalls;

a wash cloth bin attached to said hamper with at least one of said connection means and holding a plurality of wash cloths within a wash cloth bin interior comprising:

a rear wash cloth bin wall, a pair of wash cloth bin sidewalls, a wash cloth bin bottom, a wash cloth bin top;

a pair of wash cloth bin stiles attached to front edges of said pair of wash cloth bin sidewalls;

a wash cloth bin tray attached to said wash cloth bin bottom via a wash cloth bin spring, said wash cloth bin spring biasing said wash cloth bin tray towards said wash cloth bin top; and a wash cloth bin door hingedly attached to one wash cloth in stile and capable of being secured to an opposite washcloth bin stile further having a wash cloth bin door aperture in communication with said wash cloth bin interior;

wherein said wash cloth bin tray retains a vertical stack of said plurality of wash cloths thereon.

3. A dispenser, comprising:

a towel bin holding a plurality of towels within a towel bin interior, further having a plurality of connection means upon an exterior thereof comprising:

a rear towel bin wall, a pair of towel bin sidewalls, a towel bin top, and a towel bin bottom;

a pair of towel bin stiles attached to front edges of said pair of towel bin sidewalls;

a towel bin tray attached to said towel bin bottom via a towel bin spring, said towel bin spring biasing said towel bin tray towards said towel bin top;

a towel bin door hingedly attached to one towel bin stile and capable of being secured to an opposite towel bin stile, further having a towel bin door aperture in communication with said towel bin interior;

a towel bar disposed along an outer face of said towel bin door;

a plurality of connection means upon an exterior of said towel bin comprising:

a first connector affixed to an exterior of a sidewall of said towel bin;

a second connector is affixed to an exterior of a sidewall of said hamper;

a third connector affixed to an exterior of a sidewall of said wash cloth bin;

a fourth connector is affixed to an exterior of a sidewall of said cabinet;

wherein an individual first connector is removably interconnected to an individual second connector;

wherein another individual first connector is removably interconnected to an individual third connector;

wherein yet another individual first connector is removably interconnected to an individual fourth connector, wherein said towel bin tray retains a vertical stack of said plurality of towels, thereon;

a towel bin first latch located on said towel bin bottom correspondingly engaging a towel bin second latch located on said towel bin tray to retain said towel bin tray at a desired elevation above said towel bin bottom;

a hamper attached to said towel bin with at least one of said connection means, receiving a plurality of items within a hamper interior comprising:

a planar bottom;

four planar vertical hamper sidewalls;

a wash cloth bin attached to said hamper with at least one of said connection means and holding a plurality of wash cloths within a wash cloth bin interior comprising:

a rear wash cloth bin wall, a pair of wash cloth bin sidewalls, a wash cloth bin bottom, a wash cloth bin top;

a pair of wash cloth bin stiles attached to front edges of said pair of wash cloth bin sidewalls;

a wash cloth bin tray attached to said wash cloth bin bottom via a wash cloth bin spring, said wash cloth bin spring biasing said wash cloth bin tray towards said wash cloth bin top;

a wash cloth bin door hingedly attached to one wash cloth in stile and capable of being secured to an opposite washcloth bin stile further having a wash cloth bin door aperture in communication with said wash cloth bin interior;

wherein said wash cloth bin tray retains a vertical stack of said plurality of wash cloths thereon;

a cabinet attached to said towel bin with at least one of said connection means and receives another plurality of items within a cabinet interior comprising:

a cabinet rear wall, a pair of cabinet sidewalls, a cabinet bottom, and a cabinet top;

a first cabinet stile attached to a front edge of one cabinet sidewall;

a second cabinet stile attached to a front edge of an opposite cabinet sidewall;

a cabinet first door hingedly attached to said first cabinet stile;

a cabinet bin second door hingedly attached to said second cabinet stile;

a cabinet door pull attached to a mid-portion of said cabinet first door;

a cabinet door latch assembly securing both said cabinet first door and said cabinet second door in a closed position to said cabinet top; and a planar cabinet shelf attached to the interior of said pair of cabinet sidewalls.

4. A dispenser, comprising:

a towel bin holding a plurality of towels within a towel bin interior, further having a plurality of connection means upon an exterior thereof comprising:

a rear towel bin wall, a pair of towel bin sidewalls, a towel bin top, and a towel bin bottom;

a pair of towel bin stiles attached to front edges of said pair of towel bin sidewalls;

a towel bin tray attached to said towel bin bottom via a towel bin spring, said towel bin spring biasing said towel bin tray towards said towel bin top;

a towel bin door hingedly attached to one towel bin stile and capable of being secured to an opposite towel bin stile, further having a towel bin door aperture in communication with said towel bin interior;

a towel bar disposed along an outer face of said towel bin door;

a plurality of connection means upon an exterior of said towel bin comprising:

a first connector affixed to an exterior of a sidewall of said towel bin;

a second connector is affixed to an exterior of a sidewall of said hamper;

a third connector affixed to an exterior of a sidewall of said wash cloth bin;

a fourth connector is affixed to an exterior of a sidewall of said cabinet; wherein an individual first connector is removably interconnected to an individual second connector;

wherein another individual first connector is removably interconnected to an individual third connector;

wherein yet another individual first connector is removably interconnected to an individual fourth connector, wherein said towel bin tray retains a vertical stack of said plurality of towels, thereon;

a towel bin first latch located on said towel bin bottom correspondingly engages a towel bin second latch located on said towel bin tray to retain said towel bin tray at a desired elevation above said towel bin bottom;

a hamper attached to said towel bin with at least one of said connection means, receives a plurality of items within a hamper interior comprising:

a planar bottom;

four planar vertical hamper sidewalls;

a cabinet attached to said towel bin with at least one of said connection means and receives another plurality of items within a cabinet interior comprising:

a cabinet rear wall, a pair of cabinet sidewalls, a cabinet bottom, and a cabinet top;

a first cabinet stile attached to a front edge of one cabinet sidewall;

a second cabinet stile attached to a front edge of an opposite cabinet sidewall;

a cabinet first door hingedly attached to said first cabinet stile;

a cabinet bin second door hingedly attached to said second cabinet stile;

a cabinet door pull attached to a mid-portion of said cabinet first door;

a cabinet door latch assembly securing both said cabinet first door and said cabinet second door in a closed position to said cabinet top; and a planar cabinet shelf attached to the interior of said pair of cabinet sidewalls.

* * * * *